United States Patent [19]

Carley et al.

[11] Patent Number: 4,470,333

[45] Date of Patent: Sep. 11, 1984

[54] GENERATION OF MUSICAL TONES FROM MULTIPLEXED SERIAL DATA

[75] Inventors: Joseph C. Carley, Sycamore; Anthony C. Ippolito, DeKalb, both of Ill.

[73] Assignee: The Wurlitzer Company, DeKalb, Ill.

[21] Appl. No.: 450,781

[22] Filed: Dec. 17, 1982

Related U.S. Application Data

[63] Continuation of Ser. No. 165,773, Jul. 3, 1980, abandoned.

[51] Int. Cl.[3] ..... G10H 1/02

[52] U.S. Cl. ..... 84/1.24; 84/DIG. 22; 84/DIG. 26

[58] Field of Search ..... 84/1.01, 1.03, 1.17, 84/1.24, DIG. 22, DIG. 26

[56] References Cited

U.S. PATENT DOCUMENTS

| | | | |
|---|---|---|---|
| 3,610,799 | 10/1971 | Watson | 84/1.01 |
| 3,610,800 | 10/1971 | Deutsch | 84/1.01 |
| 3,749,837 | 7/1973 | Doughty | 84/1.01 X |
| 3,816,637 | 6/1974 | Whitefield | 84/1.24 |
| 4,012,982 | 3/1977 | Southard | 84/1.01 |
| 4,208,939 | 6/1980 | Wangard et al. | 84/DIG. 22 |

*Primary Examiner*—Stanley J. Witkowski

*Attorney, Agent, or Firm*—Trexler, Bushnell & Wolters, Ltd.

[57] ABSTRACT

Multiplexed serial data from the keyboard of a musical instrument, such as an electronic organ, is delayed in a shift register to cause generation of musical tones related to the keyswitches closed on the keyboard and combined with the non-delayed serial data for producing mutation voices or chords.

7 Claims, 6 Drawing Figures

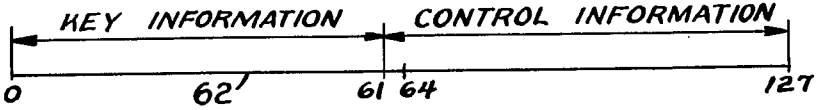
Fig. 3
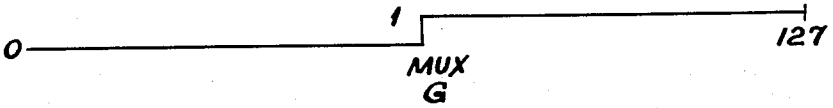
Fig. 4
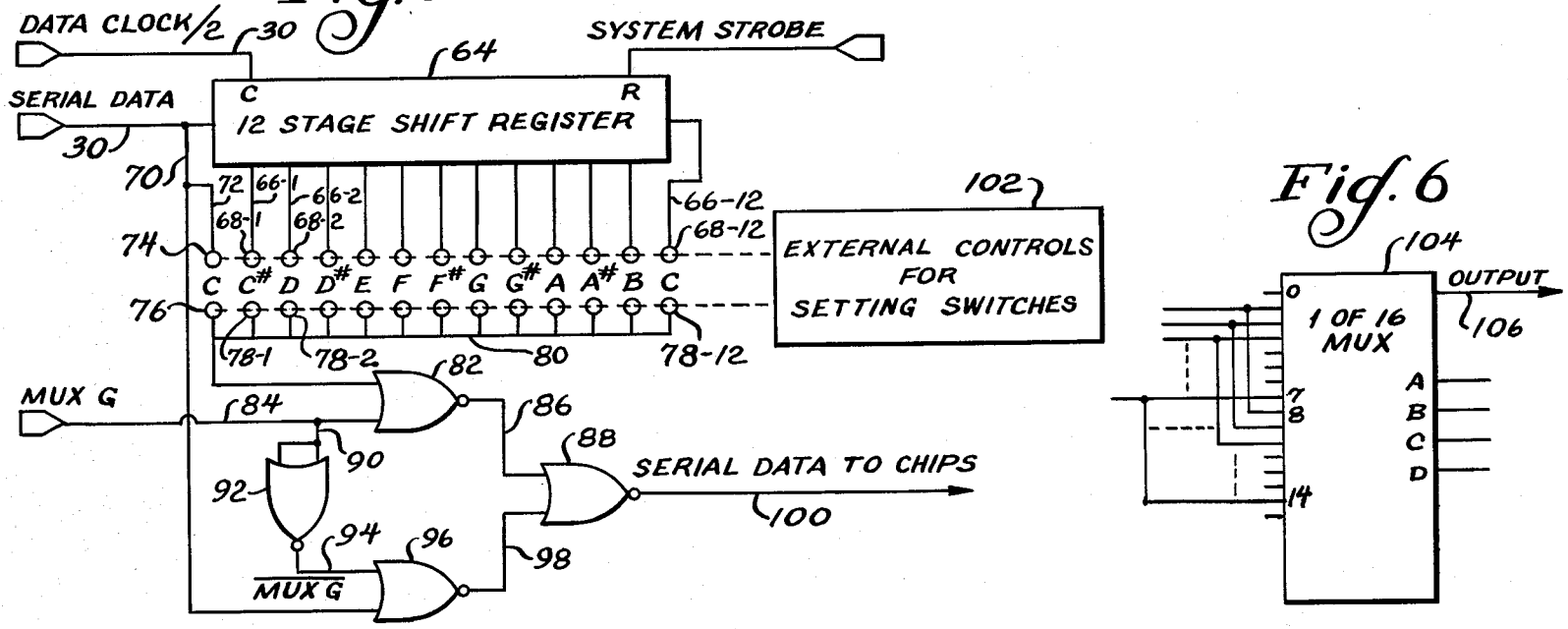
Fig. 5
Fig. 6

GENERATION OF MUSICAL TONES FROM MULTIPLEXED SERIAL DATA

This information is a continuation of 165,773, filed July 3, 1980, and now abandoned.

BACKGROUND OF THE INVENTION

In order to avoid the complexity and expense of individual wiring of organ keyboards it has become known to utilize multiplexing of the keyboard, see for example Watson U.S. Pat. No. 3,610,799. A serial data stream is thus generated with pulses in the serial data stream indicating which notes are to be played. Other information also may be carried such as the condition of various controls including the position of stop tablets. The pulses in the serial data stream provide information to electronic tone generating circuitry to effect production of tones corresponding to keys that are depressed on the keyboard to close corresponding keyswitches.

The production of transposition by selectively delaying the serial data stream also is known as disclosed in Deutsch U.S. Pat. No. 3,610,800.

OBJECTS AND SUMMARY

The present invention advances over prior multiplexed organs and the like in providing a time delay to the serial data stream, and combining the delayed stream with the non-delayed stream to generate mutation frequencies, chords, couplers, and chimes effects.

THE DRAWINGS

The invention will best be understood with reference to the ensuing specification when taken in connection with the accompanying drawings wherein:

FIG. 3 is a timing diagram illustrating the different types of information carried by the serial data stream in one multiplexing scan;

FIG. 4 is a diagram in time relation with the diagram of FIG. 3 illustrating the state of a particular potential at a given time;

FIG. 5 is a circuit diagram illustrating the present invention as utilized to provide a chord generator; and FIG. 6 is a circuit diagram of an addition to the circuits of the present invention to produce a chimes effect.

DETAILED DESCRIPTION

Figures 1, 2:
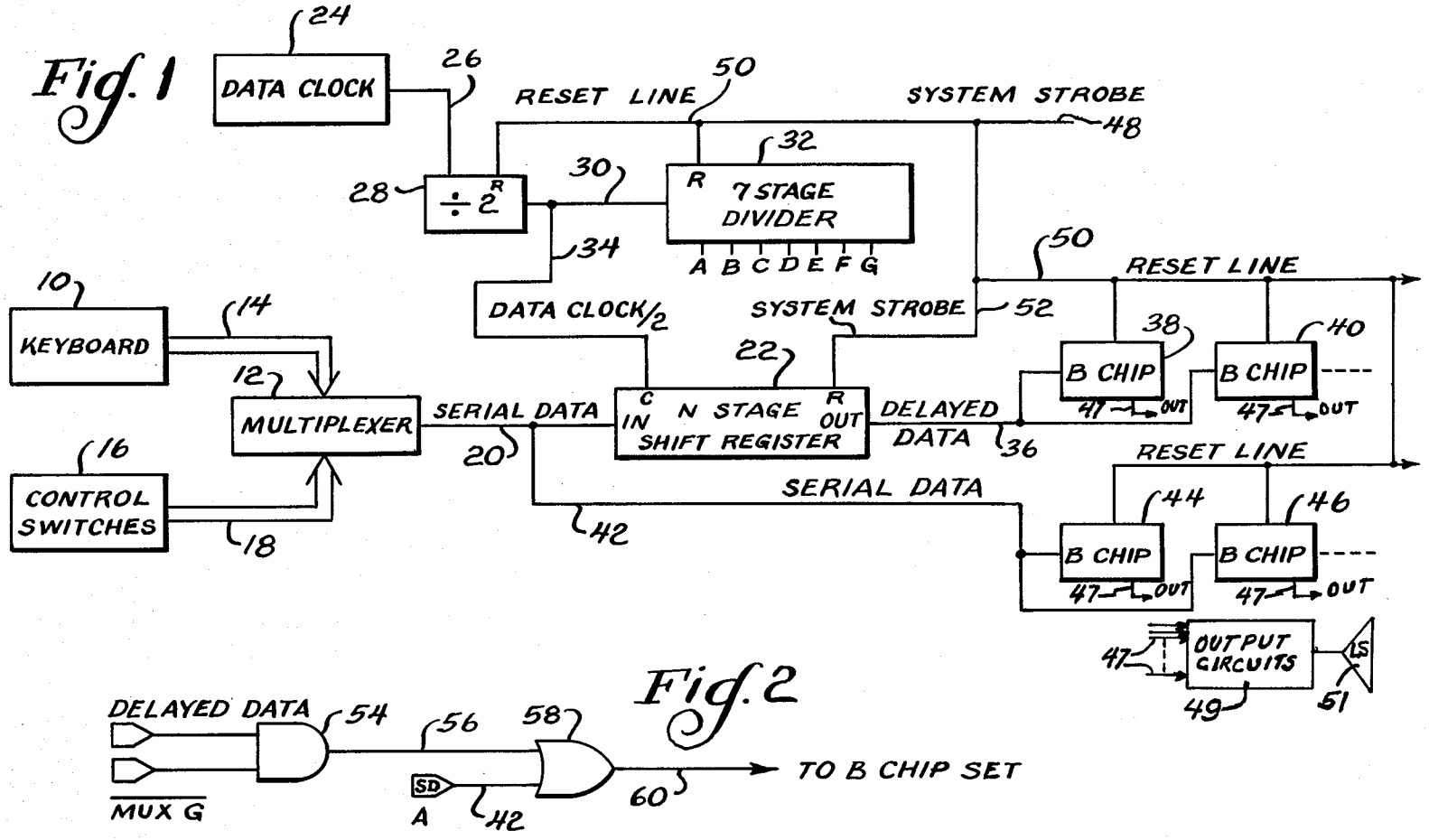
FIG. 1 is a circuit diagram illustrating the underlying principles of the present invention.
FIG. 2 illustrates a modification of the circuit of FIG. 1.

Referring now in greater particularity to the drawings, and to FIG. 1 there is shown a keyboard 10 which will be understood to comprise the usual organ keyboard having a plurality of keys, for example 61 for a full organ, or a lesser number for the well-known spinet organ. Each key of the keyboard will be understood as having at least one keyswitch which is connected to a multiplexer 12 as indicated at 14. Similarly, various control switches 16 are connected to the multiplexer at 18. The control switches may include stop tablets for various organ voicing, or control switches for accompaniment rhythm effects, etc. The multiplexer scans the various switches from bottom to top, i.e., an up-scan.

Serial data from the multiplexer is carried by a line 20 leading to the input of an N stage register 22.

A data clock 24 is connected by a line 26 to a divide-by-two circuit 28. The divide-by-two circuit 28 has an output line 30 leading to a seven-stage divider 32. The outputs of this divider, indicated at A through G are connected to the multiplexer 12 in conventional fashion to operate the mulitplexer. The output line 30 of the divide-by-two circuit 28 has another line 34 connected thereto which leads to the C or "clock" input of the aforementioned shift register 22.

The output of the shift register 22 is applied to a line 36 which carries delayed data similar to the serial data on line 20, but delayed by the number of counts possible from the N stage shift register. The delayed data line 36 is individually connected to a series of B chips 38, 40 etc. These B chips are constructed in accordance with Schwartz et al Ser. No. 917,313, now U.S. Pat. No. 4,203,337 or Schwartz et al 917,314, now U.S. Pat. No. 4,256,002, or Schwartz et al Serial No. 962,981, abandoned. As is set forth in greater detail in each of the foregoing applications, each B chip is capable of producing any frequency of any note of the organ, and is assigned by the serial data, in the present instance the delayed data, to produce the frequency corresponding to a note played on the keyboard 10.

The serial data line 20 is provided with a branch 42 which leads to an additional sequence of B chips, 44, 46, etc.

Each B chip is provided with a plurality of output terminals schematically represented in FIG. 1 by a single output 47. The output terminals are respectively connected to output circuits 49 including filters, couplers, etc., in which the B chip outputs are ultimately combined and connected to an output amplifier which feeds a loudspeaker system 51 or other suitable electro-acoustic translating means.

The system strobe 48 is derived from the counts of the divider 32 in a known manner, and is connected to the reset line 50 for the divide-by-two circuit 28 and the seven-stage divider 32. A branch reset line is connected to the B chips 38, 40, etc., and 44, 46, etc. A further connection is made from the previously mentioned reset line, hereinafter identified with numeral 50, to a further system strobe line 52 connected to the reset terminal of the shift register 22. The system strobe and various reset line connections ensure proper synchronization of all parts of the circuit.

The serial data lines 20 and 42 leading direct to the set of B chips, 44, 46, etc., cause the B chips to generate frequencies corresponding to the notes of the keys depressed in the keyboard 10. On the other hand, the delayed data on the line 36 from the end stage of the shift register 22 as applied to the set of B chips 38, 40, etc., cause this set of B chips to produce frequencies related to the keys depressed on the keyboard 10, but not the same as such keys. As stated otherwise, each switch of each keyboard (or keyboards) has its own time slot according to the multiplex scan. Thus, when a given closed switch is encountered there will be a corresponding 1 on the serial data at that time slot. Each time slot has its corresponding frequency. Thus, the set of B chips 44, 46, etc., produces frequencies exactly the same as that of the notes corresponding to the closed keyswitches of the keyboard. On the other hand, since the data is delayed to the set of B chips 38, 40, etc., mutation frequencies are produced.

A modification of the invention is illustrated in FIG. 2. In this figure the delayed data line is connected to a two input AND gate 54. The other input to the AND gate 54 is $\overline{MUX\ G}$. The output 56 from the AND gate 54 is connected to one input of a two input OR gate 58. The other input to the OR gate comprises the serial data as on line 42, for example. The OR gate has an output 60 leading to a single B chip set, for example the set of B chips 44, 46, etc. In accordance with the modification of FIG. 2 the same set of B chips will produce both the fundamental and the mutation tones.

In FIG. 3 a time base is shown at 62 corresponding to the counts of the seven-stage counter 32, which will be recognized as being a binary counter. With the seven stages and the outputs thereof the time base runs from 0 to 127. Key information is provided in the serial data line 20 from the multiplexer on counts 1 to 61. Control information is provided from count 61 to count 127. FIG. 4 is aligned vertically with FIG. 3 and shows the condition MUX G, being 0 from count 0 to count 63, and being 1 from count 64 to count 127. $\overline{MUX\ G}$ is the inverse of MUX G. MUX G comprises output G of the seven-stage divider 32. The inverse of MUX G, namely $\overline{MUX\ G}$ is used in order that a zero into the AND gate 54 will not let the delayed control information through. The OR gate 58 responds to either or both the delayed data or the serial data which is not delayed. It will be apparent that positive logic is being used herein.

FIG. 5 is similar to portions of FIG. 1, and provides for the production of chords. The data clock/2 line 30 is connected to the C or "clock" input of a 12 stage shift register 64. The 12 stages are chosen in correspondence to the 12 semi-tones of a musical octave. The 12 outputs 66-1, 66-2, through 66-12 are respectively connected to fixed switch contacts illustrated at 68-1, 68-2, through 68-12.

The serial data line 30 is connected to the input of the 12 stage shift register 64, and is connected by means of a branch connection 70 and a further branch connection 72 to a switch contact 74.

A fixed switch contact 76 corresponds to the fixed switch contact 74. Subsequent switch contacts 78-1, 78-2, through 78-12 correspond to the switch contacts 68-1, 68-2 through 68-12. All of the switch contacts 76 and 78 are connected to a common buss 80 which leads to one input of a two input NOR gate 82. MUX G is connected to a line 84 which leads to the second input of the two input NOR gate 82. The output 86 from the NOR gate 82 is connected to one input of a two input NOR gate 88.

The MUX G line 84 also is connected by a branch connection 90 to both inputs of a two input NOR gate 92, which therefore serves simply as an inverter. The output of the NOR gate 92 is connected at 94 to one input of a two input NOR gate 96. The second input of the NOR gate 96 comprises the serial data on the line 70 previously mentioned. The output of the NOR gate 96 is connected at 98 through the second input of the NOR gate 88. The output of the NOR gate 88 at 100 leads to the B chip set and comprises serial data.

The switches comprising the contacts 74, 76, and 68-1 through 68-12 and 78-1 through 78-12 are controlled by external controls 102. For example, if the contacts 74 and 76 are connected as by a suitable electronic gate, then the serial data on line 70 will be applied as an input to the NOR gate 82 without delay. If the E contacts 68-4 and 78-4 and also the G contacts 68-7 and 78-7 are respectively connected, then delayed pulses corresponding to the E and G notes will also appear on the collector 80 and a C chord will be produced.

As noted before MUX G comprises the second input to the NOR gate 82. A 1 on either input to the NOR gate 82 forces a 0 on the line 86. This, of course, provides a 0 on the line 86 through the entire second half of the multiplex scan, since MUX G is high during that period. Since the NOR gate 92 serves as an inverter, $\overline{MUX\ G}$ appears on line 94. $\overline{MUX\ G}$ is 1 during the first half of a scan, thus forcing a 0 on the output 98 during that period. On the other hand, $\overline{MUX\ G}$ is 0 during the second half of the scan, whereby serial data comprising control data will determine the output on the line 98.

The output of the NOR gate 88 on line 100 thus will comprise serial data to the chips with the count corresponding to the notes selected either not delayed or delayed, or both in the case of chords, in accordance with the setting of the switches as previously noted.

In order to produce a chimes sound it may be necessary, in effect, to back up the entire keyboard. For example, it may be desired to play a C note, an E note below the C, G and C an octave above. In order to get the E below the C it is necessary to back up the keyboard eight notes or time slots. A 1 of 16 multiplexer commercially available under No. 74 150 provided at 104 in FIG. 6. National Semiconductor Corporation of Santa Clara, Calif. is one source of this multiplexer. Information in the form of serial data is presented to the input of this multiplexer in eight bit (or time slots) chunks from a one of eight multiplexer. Due to utilization of commercially available components the multiplexer 12 comprises sixteen one of eight multiplexers connected to a one of sixteen multiplexer. It is one of these one of eight multiplexers that is used here. Prerequisite serial data is present, and in order to get the note or notes below those actually played it is necessary not to take the serial date in normal or right order. Due to the one of eight multiplexer the data repeats once every 1/16 scan frame. The inputs of the multiplexer 104 are wired together in pairs, input 1 being connected to input 8, input 2 being connected to input 9, etc. Input connections A, B and C are the normal one of eight. Input D cycles inputs 0 through 7 when D equals 0, and cycles inputs 8–15 when D equals 1. The output then is taken at 106 as serial data transmitted to the set of B chips.

Mutations of multiplexed serial data corresponding to musical tones are produced as heretofore set forth for the various effects noted. The specific illustrative examples are exemplary only, and those skilled in the art will no doubt be able to provide other examples which will be understood as forming a part of the present invention insofar as they fall within the spirit and scope of the appended claims.

The invention is claimed as follows:

1. Tone generating means for an electronic musical instrument comprising a keyboard having a plurality of keys each having a musical name note and a like plurality of keyswitches respectively moved from inactive to active position by selective manual operation of said keys, multiplexing means interconnected with said keyswitches to scan from bottom to top thereof for generating a primary serial data stream having one or more time encoded pulses corresponding to active keyswitches, each pulse in said serial data stream corresponding to a predetermined musical note, means for shifting the time position of at least one of said pulses to produce a second data stream in which at least one of said pulses corresponds to a note other than said predetermined notes, said shifting means including a twelve stage shift register having twelve delayed outputs and an undelayed output corresponding to the input, a common buss and manually controllable switch means for selectively connecting one or a plurality of said delayed and undelayed outputs to said common buss, said primary data stream remaining unchanged, and means for producing musical notes corresponding to the pulses in both said unchanged primary and said second data streams.

2. Tone generating means as set forth in claim 1 and further including means for combining said primary data stream and said second data stream to produce a composite data stream, said composite data stream being fed to said musical note producing means.

3. Tone generating means as set forth in claim 1 wherein a single pulse in said primary data stream is shifted to a plurality of different positions in said second data stream.

4. Tone generating means as set forth in claim 3 in which the single pulse is delayed by different counts to provide said plurality of positions to produce a musical chord.

5. Tone generating means as set forth in claim 1 wherein said means for producing musical notes comprise note producing means receiving the primary date stream and separate note producing means receiving the second data stream.

6. Tone generating means as set forth in claim 1 wherein the pulse time position shifting means comprises a shift register.

7. Tone generating means for an electronic musical instrument comprising a keyboard having a plurality of keys each having a musical name note and a like plurality of keyswitches respectively moved from inactive to active position by selective manual operation of said keys, multiplexing means interconnected with said keyswitches to scan from bottom to top thereof for generating a primary serial data stream having one or more encoded pulses corresponding to active keyswitches, each pulse in said serial data stream corresponding to a predetermined musical name note, means for shifting the time position of at least one of said pulses both forwardly and rearwardly to produce a second data stream in which at least one of said pulses corresponds to a note other than said predetermined notes, and means for producing musical notes corresponding to the pulses in both said unchanged primary and said second data streams, thereby producing a chimes effect, said means for shifting a pulse rearwardly comprising a 1 of 16 multiplexer having inputs 0 through 15 for serial data wired together in pairs in a repeatable cycle of 8, a 1 of 8 multiplexer supplying serial data to said inputs, and an input control for utilizing either inputs 0 through 7 or 8 through 15.

* * * * *